United States Patent [19]

Sigg

[11] Patent Number: 4,733,612

[45] Date of Patent: Mar. 29, 1988

[54] SABOT PROJECTILE, ESPECIALLY ARROW PROJECTILE

[75] Inventor: Hanspeter Sigg, Jestetten, Fed. Rep. of Germany

[73] Assignee: Werkzeugmaschinenfabrik Oerlikon-Bührle AG, Zürich, Switzerland

[21] Appl. No.: 67,165

[22] Filed: Jun. 29, 1987

[30] Foreign Application Priority Data

Jul. 7, 1986 [CH] Switzerland ..... 02732/86

[51] Int. Cl.[4] ..... F42B 13/16

[52] U.S. Cl. ..... 102/521; 102/511

[58] Field of Search ..... 102/520–527, 102/511

[56] References Cited

U.S. PATENT DOCUMENTS

| | | | |
|---|---|---|---|
| H265 | 5/1987 | Bonde et al. | 102/521 |
| 2,996,011 | 8/1961 | Dunlap . | |
| 3,000,316 | 9/1961 | Dunlap et al. . | |
| 3,738,279 | 6/1973 | Eyre et al. . | |
| 4,029,018 | 6/1977 | Bjornson | 102/521 |
| 4,142,467 | 3/1979 | Stahlmann et al. | 102/523 |
| 4,469,027 | 9/1984 | Burns et al. . | |
| 4,517,899 | 5/1985 | Haberli | 102/521 |

FOREIGN PATENT DOCUMENTS 2007822 9/1970 Fed. Rep. of Germany .

*Primary Examiner*—Harold J. Tudor

*Attorney, Agent, or Firm*—Werner W. Kleeman

[57] ABSTRACT

Sabot projectiles, especially arrow or fin-stabilized projectiles, should possess as small as possible spin so that they do not begin to oscillate or wobble (nutation) in the air. On the other hand, for the detachment of the sabot from the projectile body at the muzzle of the weapon barrel, it is advantageous if the sabot possesses a spin. According to the invention this objective is attained in that the projectile body or projectile is threaded into the sabot and can rotate relative to such sabot. The threads for threadably connecting the projectile body or projectile with the sabot have a thread course or direction which corresponds to the rifling twist of the weapon barrel. Furthermore, the magnitude of the thread pitch angle $\alpha$ essentially corresponds to the sliding friction angle $\mu$ between the projectile body or projectile and the sabot.

11 Claims, 2 Drawing Figures

SABOT PROJECTILE, ESPECIALLY ARROW PROJECTILE

BACKGROUND OF THE INVENTION

The present invention broadly relates to ammunition rounds for weaponry and, more particlarly, concerns a new and improved construction of a sabot projectile, especially although not exclusively an arrow or fin-stabilized projectile.

In its more specific aspects, the present invention relates to a new and improved construction of a sabot projectile, particularly an arrow or fin-stabilized projectile, which is of the type comprising a projectile body or projectile, also referred to in the art sometimes as a missile, particularly an arrow projectile, comprising external threads or thread means, especially, by way of example, buttress threads. The sabot projectile further contains a sabot, especially a sabot formed of a conventional light metal, which sabot is provided with reference fracture locations, cartridge grooves and internal threads or thread means into which there is threaded or screwed the projectile body or projectile. The sabot projectile also contains a sabot jacket formed of a plastic material and equipped with weapon barrel or bore guide sections and reference fracture locations, and there is also provided a hood or hood member formed of a plastic material.

With a heretofore known sabot projectile of this type, as disclosed in German Patent Publication No. 2,924,036, published Feb. 14, 1980, wherein there is particularly described an arrow or fin-stabilized projectile, the spin of the sabot should be transmitted as completely as possible to the projectile body or projectile. This projectile body therefore is provided with recesses serving as holding means. Engaging into the recesses serving as such holding means is the sabot for the purpose of transmitting the forces, by means of further holding means provided at the sabot and constructed as dogs or cans, arising between the sabot and the projectile body. These holding means form grooves or threads or thread means having a pitch angle $\alpha=0°$.

However, it is also known from, for instance, the aforementioned German Patent Publication No. 2,924,036 and the German Patent Publication No. 1,703,507, published Mar. 9, 1972 to arrange a standard thread or thread means between the projectile body and the sabot.

What is disadvantageous with this state-of-the-art arrow or fin-stabilized projectile is that in the presence of considerable spin there is no longer insured the requisite stability of the projectile body, especially an arrow-shaped projectile body.

SUMMARY OF THE INVENTION

With the foregoing in mind, it is therefore a primary object of the present invention to provide a new and improved construction of a sabot projectile, in particular but not exclusively an arrow or fin-stabilized projectile, which is not afflicated with the aforementioned drawbacks and shortcomings of the prior art constructions.

Another important object of the present invention is directed to the provision of an improved construction of a sabot projectile or missile of the aforementioned type, which remains essentially completely stable throughout its flight path and the spin of which is correspondingly small.

Yet a further significant object of the present invention is directed to a new and improved construction of a sabot projectile or missile which is relatively simple in construction and design, quite economical to manufacture, possesses outstanding flight stability and wherein there is still insured for reliable detachment of the sabot from the projectile or missile upon departure from the muzzle of the firing weapon or weapon barrel.

A further noteworthy object of the present invention is directed to a new and improved construction of a sabot projectile which is of relatively simple construction and design, therefore can be economically fabricated, and nonetheless possesses an extremely stable flight path or trajectory after firing thereof, yet is nonetheless structured so that after departure of the sabot projectile from the weapon barrel reliable detachment of the sabot from the projectile is afforded.

Now in order to implement these and still further objects of the invention, which will become more readily apparent as the description proceeds, the sabot projectile or missile of the present invention is manifested by the features that the projectile body or projectile is rotatably mounted in the sabot, and that the threads or thread means for interconnecting the projectile with the sabot have a thread course or direction which corresponds to the direction or course of the rifling twist of the weapon barrel, and furthermore, the magnitude of the thread pitch angle $\alpha$ approximately corresponds to the sliding friction angle or friction angle $\mu$ between the projectile body and the sabot.

By virtue of the construction of the sabot projectile according to the teachings of the present invention there is realized a sabot projectile which, among other things, has at least the following advantages:

(a) There is afforded a clean detachment or separation of the sabot from the projectile body or projectile, since the sabot has imparted thereto the complete or full spin and radially is propelled away, under the action of the centrifugal force as soon as the projectile has departed from the weapon barrel or bore.

(b) The projectile body can have imparted thereto any randomly desired spin, between zero up to the maximum spin, which is essentially of the same magnitude as the spin of the sabot, in other words, there can be imparted to the projectile body or projectile that spin which is most favorable for its flight stability.

(c) There can be introduced propellent gas beneath the hood or hood member of the sabot projectile, in order to blast away or detach such hood or hood member following departure or exiting of the projectile from the weapon barrel.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the construction of the sabot projectile or missile has been illustrated therein as is needed for one skilled in the art to readily understand the underlying principles and concepts of the present invention.

Figure 1:
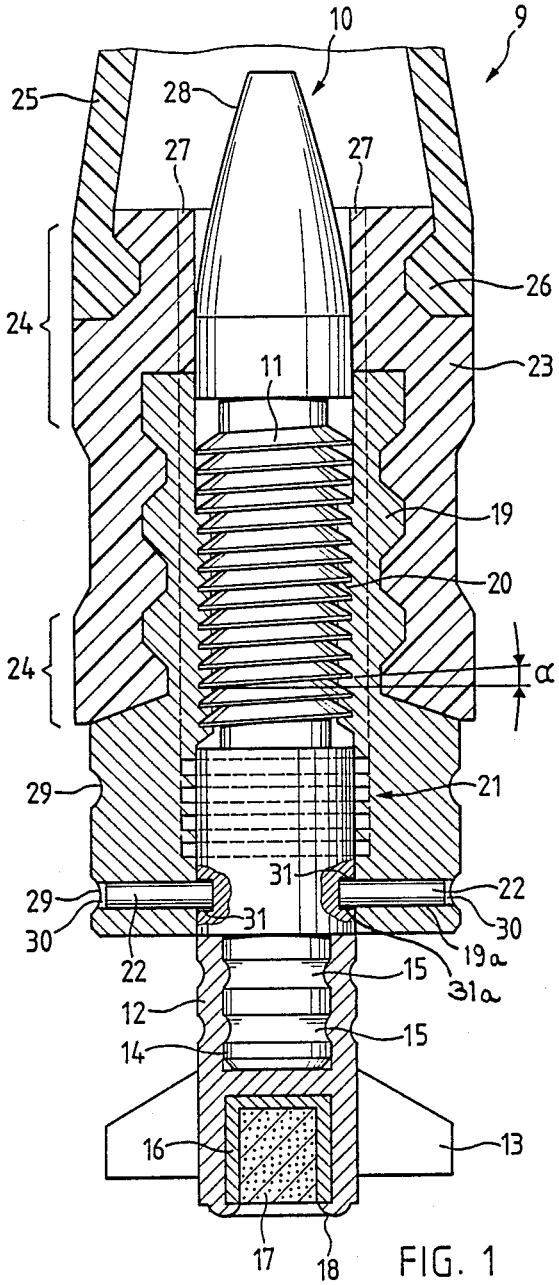
FIG. 1 is a fragmentary longitudinal sectional view through a sabot projectile or missile constructed according to the teachings of the present invention.

Turning now to the accompanying drawings, and specifically directing attention initially to FIG. 1 thereof, the exemplary embodiment of sabot projectile or missile 9 depicted therein will be seen to comprise an arrow-shaped projectile body or projectile 10, which also can be referred to as a heavy metal core. This arrow-shaped projectile body or projectile 10 contains at its central portion or section threads or thread means, preferably a buttress thread or thread means 11. The threads or thread means 11 possess a thread pitch angle $\alpha$, which has been illustrated in FIG. 1 of the drawings, and the significance of which will be explained more fully hereinafter. The sabot projectile or missile 9 will also be seen to comprise a sleeve 12 at which there are appropriately secured, for instance, six stabilization or stabilizing fins 13 or equivalent structure. This sleeve or sleeve member 12 is mounted upon a pin or plug 14 of the projectile body or projectile 10 and which is located at the rear end of such projectile body or projectile 10. This pin or plug 14 possesses grooves or circumferential notches 15 or equivalent structure into which there can be pressed the sleeve or sleeve member 12. In this way the sleeve or sleeve member 12 can be appropriately secured to the pin or plug 14.

Continuing, it will be observed that a tracer or flare sleeve 16 containing a suitable tracer or flare charge or composition 17 is located at the rear end of the sleeve or sleeve member 12. A flanged portion or flange means 18 prevents the tracer or flare sleeve or sleeve member 16 together with its tracer or flare charge 17 from falling out of the sleeve or sleeve member 12.

The sabot projectile or sabot 9 further contains a sabot or sabot member 19, which also can be designated as a propellent cage. This sabot or sabot member 19 possesses internal threads or thread means 20 and thus can be threadably connected or screwed onto the threads or thread means 11 of the projectile body or projectile 10. This sabot or sabot member 19 possesses grooves 21, forming a labyrinth seal, and the purpose of which will be explained more fully hereinafter.

Figure 2:
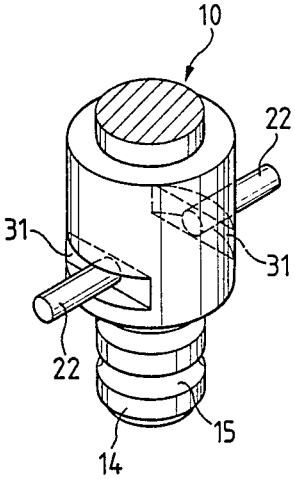
FIG. 2 is a perspective illustration of part of the sabot projectile depicted in FIG. 1, and specifically the rear portion of the projectile body or projectile.

Additionally, and as will be observed by referring to FIGS. 1 and 2, two pins or pin members 22 or the like, which protrude through radial bores 19*a* in the sabot or sabot member 19, project into appropriate blindhole bores 31*a* provided at the projectile body or projectile 10 and normally secure the sabot or sabot member 19 against rotation relative to the projectile body or projectile 10. These pins or pin members 22 are retained by a not particularly illustrated but conventional cartridge case or sleeve and are radially shifted or displaced by the spin imparted to the sabot projectile 9, so that the projectile body 10 can already rotate while located in the weapon barrel or bore of the firing weapon relative to the sabot or sabot member 19, as will be explained more fully hereinafter.

Also provided for the sabot projectile 9 is a sabot jacket 23 which surrounds the sabot or sabot member 19. This sabot jacket 23 contains two barrel guide sections or portions 24 which protrude into not particularly illustrated but conventional rifling or the like of the weapon barrel and impart a spin to the sabot projectile 9 upon firing thereof. This sabot jacket 23 is preferably formed of a suitable plastic or plastic material.

It will also be observed that the sabot projectile 9 is provided with a hood or hood member 25, preferably form of a suitable plastic material, which is secured by a suitable fastening expedient, such as a snap fastener or closure 26 at the sabot jacket 23. This hood or hood member 25, which is closed at its forward end in known manner, is shown to be hollow and can be filled with the evolving propellent gas, upon firing of the sabot projectile 9, by means of the aforementioned labyrinth seal defined by the grooves 21 and a longitudinal or lengthwise extending groove or channel 27 in such a manner that upon exit of the sabot projectile 9 from the associated weapon barrel the hollow hood or hood member 25 can be fragmented or blown off by the action of the prevailing gas pressure. It will be further observed that the projectile body or projectile 10 is provided at its front end with an ogive or frustro-conical shaped portion 28 which, as shown, protrudes into the hollow plastic hood or hood member 25.

The heretofore described sabot projectile 9 projects into a not particularly illustrated but conventional cartridge case or sleeve. At the sabot or sabot member 19 there are provided two so-called cartridge grooves 29 or equivalent structure, by means of which there can be reliably attached the cartridge case or sleeve containing the cartridge case mouth portion.

Having now had the benefit of the foregoing description of the sabot projectile of the present development, its mode of operation will be described and is as follows:

The cartridge case mouth of the not particularly illustrated cartridge case projects into the cartridge grooves 29 and prevents the sabot projectile 9 from falling out of the cartridge case. The two pins or pin members normally prevent rotation of the projectile body or projectile 10 within the sabot 19.

On the other hand, upon firing of the sabot projectile 9 these pins or pin members 22, due to the action of the prevailing centrifugal force, are radially outwardly propelled or thrusted to such an extent that now the projectile body or projectile 10 can rotate within the sabot 19, that is to say, there is rendered possible a rotational slip between the projectile body or projectile 10 and the sabot 19.

The magnitude of the thread pitch angle $\alpha$ at the buttress thread or thread means 11 and the thread course or direction are chosen such that the frictional forces between the projectile body 10 and the sabot 19 are not sufficient in order to completely transmit to the projectile body 10 the spin acceleration imparted by the sabot 19. Consequently, there is achieved the beneficial result that the projectile body or projectile 10 exits from the weapon barrel with a smaller spin or without any spin than the spin of the sabot or sabot member 19.

One of the important aspects of the invention is to select the magnitude of the thread pitch angle $\alpha$ in such a manner that the rotation of the projectile body 10 corresponds to the optimum rotational speed for an arrow or fin-stabilized projectile, in order to insure for a stable flight of the projectile body or projectile 10. In the case of a large amount of spin at the projectile body or projectile 10 there no longer can be insured for a stable flight of an arrow or fin-stabilized projectile.

Between the external or outer threads or thread means 11 of the projectile body 10 and the internal threads or thread means 20 or the sabot 19 there is preferably incorporated a so-called sliding varnish or lacquer, in other words a varnish or lacquer having good sliding properties, in order to insure for an essentially constant frictional force.

The pins or pin members 22 located in the sabot 19 are preferably supported upon beveled or flattened portions 31 provided at the projectile body or projectile 10 and do not, as previously described, protrude into blindhole bores in the projectile body 10. When using such blindhole bores there exists the danger that each pin or pin member 22 may tend to seize or bind in the related blindhole bore before it is ejected therefrom by the action of the sabot projectile spin. On the other hand, when using bevelled or flattened portions 31, such structure is capable of reliably radially outwardly displacing the associated pin or pin member 22 as soon as the projectile body 10 moves relative to the sabot or sabot member 19.

Finally, it is mentioned that instead of using the exemplary arrangement of six stabilizing fins 13 or equivalent structure, there also could only be employed two, three or four such fins or fins members 13.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A sabot projectile for firing from a weapon barrel having a predeterminate course of rifling twist, comprising:

a projectile body possessing external thread means;

a sabot possessing internal thread means;

said projectile body being threadably connected by said external thread means with the sabot by means of said internal thread means thereof;

a sabot jacket connected with said sabot;

a hood member mounted at said sabot jacket;

said projectile body being rotatably mounted at said sabot;

said external thread means of said projectile body and said internal thread means of said sabot having a thread course substantially corresponding to the predeterminate course of the rifling twist of the weapon barrel; and said external thread means of the projectile body having a thread pitch angle approximately corresponding to a predeterminate sliding friction angle prevailing between the projectile body and the sabot.

2. The sabot projectile as defined in claim 1, further including:

means defining a labyrinth seal structure between said projectile body and said sabot;

said hood member defining a hollow hood member; and means defining a propellent gas guide channel arranged between said labyrinth seal structure and said hollow hood member for blasting away said hollow hood member by propellent gases upon firing of the sabot projectile and upon exit of the projectile body from the weapon barrel.

3. The sabot projectile as defined in claim 1, further including:

sliding lacquer means provided between the external thread means of the projectile body and the internal thread means of the sabot, in order to insure for a substantially constant frictional force.

4. The sabot projectile as defined in claim 1, wherein:

said sabot being provided with at least one radial bore;

said projectile body having a beveled portion;

at least one pin arranged in said radial bore of said sabot; and said pin bearing upon said beveled portion of said projectile body in order to prevent an unintentional rotation of the projectile body in the sabot prior to firing of said sabot projectile.

5. The sabot projectile as defined in claim 1, wherein:

said external thread means of said projectile body comprise buttress thread means.

6. The sabot projectile as defined in claim 1, wherein:

said projectile body defines a substantially arrow-shaped projectile body.

7. The sabot projectile as defined in claim 1, wherein:

said sabot is formed of a light metal.

8. The sabot projectile as defined in claim 1, wherein:

said sabot jacket is formed of a plastic material.

9. The sabot projectile as defined in claim 1, wherein:

said sabot jacket contains barrel guide section means for guiding the sabot projectile within the weapon barrel.

10. The sabot projectile as defined in claim 1, wherein:

said hood member comprises a plastic hood member.

11. A sabot projectile for firing from a weapon barrel having a rifling twist of predeterminate course, comprising:

a projectile body possessing thread means;

a sabot possessing thread means mating with said thread means of the projectile body;

said projectile body and said sabot being threadably interconnected by said mating thread means;

a sabot jacket connected with said sabot;

a hood member mounted at said sabot jacket;

said projectile body being rotatably mounted at said sabot;

said thread means of said projectile body and said thread means of said sabot having a thread course substantially corresponding to the predeterminate course of the rifling twist of the weapon barrel; and said thread means of the projectile body having a thread pitch angle approximately corresponding to a predeterminate friction angle prevailing between the projectile body and the sabot.

* * * * *